United States Patent [19]

Spina

[11] Patent Number: 4,970,741

[45] Date of Patent: Nov. 20, 1990

[54] PORTABLE LIGHTWEIGHT APPARATUS FOR BEACH USE

[76] Inventor: Vincent A. Spina, 5429 Pinehurst Dr., Wilmington, Del. 19808

[21] Appl. No.: 503,294

[22] Filed: Apr. 2, 1990

[51] Int. Cl.[5] ..... A47G 9/06

[52] U.S. Cl. ..... 5/417; 5/419; 190/2

[58] Field of Search ..... 5/417–420, 5/488; 190/2

[56] References Cited

U.S. PATENT DOCUMENTS

| | | | |
|---|---|---|---|
| 2,883,682 | 2/1959 | Kwake | 5/419 |
| 2,898,609 | 8/1959 | Storie | 5/419 |
| 3,344,444 | 10/1967 | McNeal | 5/488 |
| 3,404,915 | 10/1968 | DeSouza Fillio | 5/418 X |
| 4,164,275 | 8/1979 | Davis | 190/2 |
| 4,222,468 | 9/1980 | DeFries | 5/417 X |
| 4,726,084 | 2/1988 | Kescrovich et al. | 5/417 |

*Primary Examiner*—Michael F. Trettel

*Attorney, Agent, or Firm*—Mortenson & Uebler

[57] ABSTRACT

Portable, lightweight apparatus for beach use is provided in which a generally tubular housing holds a wound up beach blanket on a convolute, spring-actuated roller wind-up mechanism. The housing has means for anchoring it into sand, pockets affixed thereto for carrying various items needed at the beach and handle means for ease of carrying. A user can carry the apparatus to the beach, anchor it into the sand, pull the towel out of the housing for use during sunbathing, use the various and sundry items carried in the pockets and, when finished, the user can roll the blanket back into the housing, detach the anchor and carry the apparatus away for use another day.

5 Claims, 1 Drawing Sheet

Fig. 2.
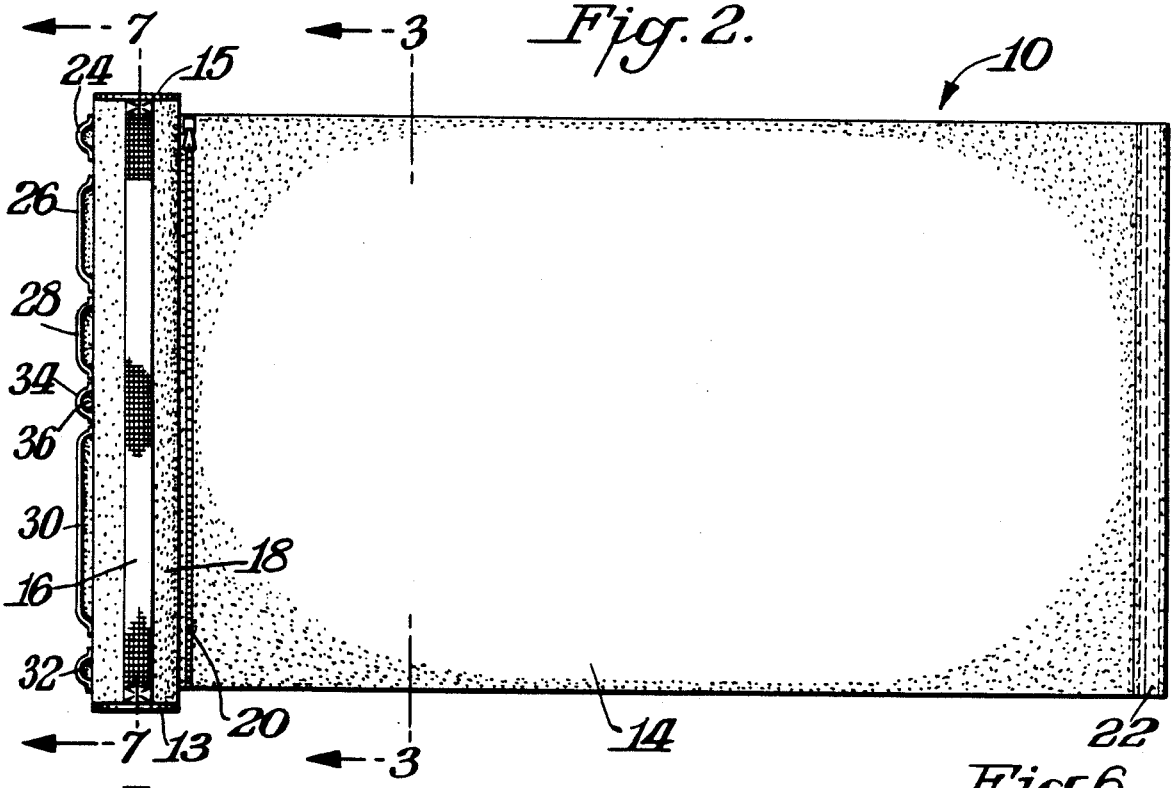
Fig. 6.
Fig. 1.
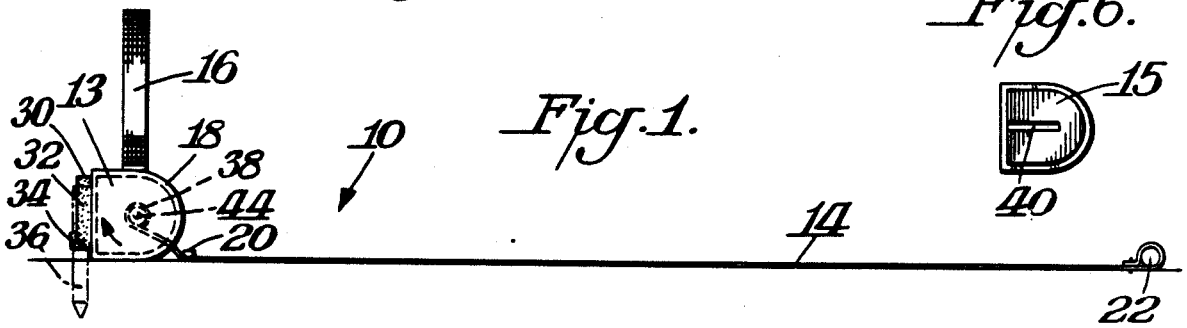
Fig. 3.
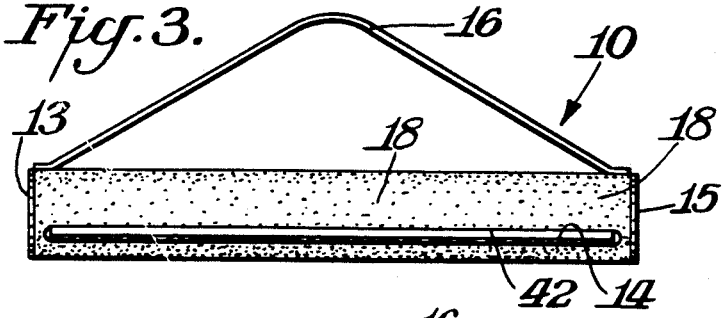
Fig. 4.
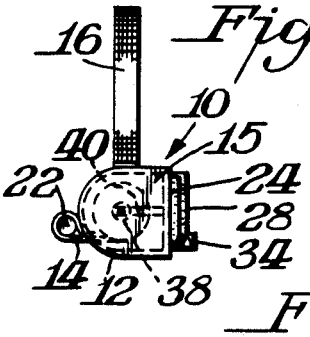
Fig. 5.
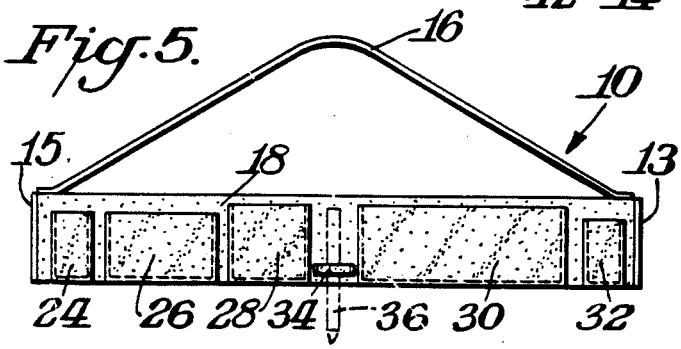
Fig. 7.
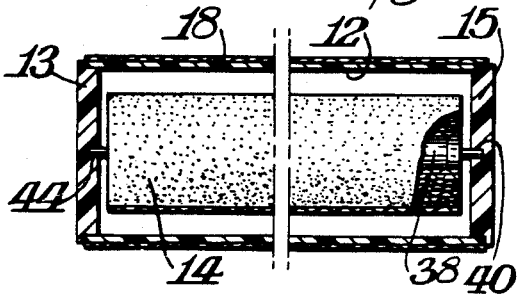

PORTABLE LIGHTWEIGHT APPARATUS FOR BEACH USE

BACKGROUND OF THE INVENTION

The invention relates to a combination beach blanket and carryall which allows a person spending a day at the beach to consolidate all of his or her necessary items into one neat, easy-to-carry package.

Anyone who has sunbathed at a beach is familiar with the difficulties associated therewith. Laying down beach blankets in an ocean breeze can be a problem. As used herein, the term "beach blanket" is synonymous with beach towel and the terms may be used interchangeably. It refers generally to an oversize towel, usually of terrycloth. Sunbathers often require various other items during sunbathing such as sunglasses, lotions, books and other items which often are misplaced, lost, rolled over or sat upon.

The invention obviates many of these difficulties associated with sunbathing.

SUMMARY OF THE INVENTION

A portable, lightweight apparatus for beach use is provided comprising, in combination, a generally tubular housing having a length approximately equal to the width of a standard beach blanket, the housing having a slot opening running along substantially its entire length. The housing contains therein a convolute, spring-actuated roller wind-up mechanism, the wind-up mechanism having affixed thereto one end of a standard beach blanket. The beach blanket extends outwardly through the slot opening and has a stop mechanism affixed to its other end remote from the wind-up mechanism. The housing has means of anchoring it in sand. The beach blanket has zipper means located in proximity to the housing and extending transversely across its entire width of the blanket. The housing has a plurality of pocket means for carrying various items that one might need at a beach. The housing also has handle means affixed thereto for carrying the apparatus.

The apparatus may be easily carried to a beach, placed on the sand at the beach and anchored therein. The blanket may be unrolled from the housing and used for sunbathing, following which the blanket may be rolled back up into the housing, the anchor means removed, and the apparatus carried away. Preferably, the exterior of the housing is upholstered for use as a pillow, the preferred upholstery being Naugahyde. The anchor means can be at least one stake extending through a loop affixed to the housing. The handle means is preferably a strap having its ends affixed to the ends of the housing.

BRIEF DESCRIPTION OF THE DRAWINGS

FIG. 1 is a right side elevational view of the combination beach blanket and carryall of the invention in the open configuration.

FIG. 2 is a top plan view of the combination depicted in FIG. 1.

FIG. 3 is an elevational view, partly in cross-section, taken along line 3—3 of FIG. 2.

FIG. 4 is a left side elevational view of the invention in the closed, or rolled up, configuration.

FIG. 5 is a rear elevation of the invention wherein various pockets and anchor means for anchoring the apparatus into sand are depicted.

FIG. 6 is a rear elevation of one end cap, slotted, of the housing of the invention.

FIG. 7 is an elevational view of the housing, partly in cross-section, taken substantially along line 7—7 of FIG. 2.

DETAILED DESCRIPTION OF THE INVENTION AND PREFERRED EMBODIMENTS WITH REFERENCE TO THE DRAWINGS

Portable, lightweight apparatus for beach use is provided in which a generally tubular housing holds a wound up beach blanket on a convolute, spring-actuated roller wind-up mechanism. The housing has means for anchoring it into sand, pockets affixed thereto for carrying various items needed at the beach and handle means for ease of carrying. A user can carry the apparatus to the beach, anchor it into the sand, pull the towel out of the housing for use during sunbathing, use the various and sundry items carried in the pockets and, when finished, the user can roll the blanket back into the housing, detach the anchor and carry the apparatus away for use another day.

A detailed description of the invention and preferred embodiments is best provided with reference to the drawings wherein FIG. 1 is a right side elevation of the combination of the invention 10 in the open configuration. The apparatus includes a generally tubular housing 12 (not seen in FIG. 1) having end caps 13 and 15 (not seen in FIG. 1) out of which extends beach blanket 14. The housing is preferably of ABS plastic, but other suitable materials may be used. A carry strap 16 is affixed as shown to each end of the housing for ease of carrying. The housing is preferably upholstered with upholstery 18, which preferably is Naugahyde, but one skilled in the art will realize that other materials may be used. In use, this housing may act as a pillow for the sunbather.

Zipper 20 extends transversely across the entire width of blanket 14, more readily seen in FIG. 2, to enable one to detach towel 14 from the rests of the apparatus for washing. Stop 22 prevents the towel end from disappearing through slot 42 into the housing when the towel is rolled up. This stop 22 may be a plastic rod, tube or dowel, a wood dowel or some other suitable material.

Also shown in FIG. 1 is one pocket 32, which will be described in more detail below.

Anchor means for holding the apparatus in the sand comprises a stake 36 extending into the sand through loop 34 affixed to the housing. More than one stake may be employed.

Inside the housing, depicted in phantom in FIG. 1, is wind-up mechanism 38 which rotates in the direction indicated by the arrow when the towel 14 is wound up. This wind-up mechanism 38 may be convolute, spring-actuated roller wind-up mechanism similar to that employed in a conventional window shade.

FIG. 2 is a top plan view of the invention 10 in the open configuration. Carrry strap 16 is affixed to each end cap 13 and 15 of the housing as shown. Beach blanket 14 is in the fully extended configuration, and stopping dowel or tube 22 tends to keep the end of the blanket flat on the beach. Zipper 20 is seen to extend across the blanket 14 and serves as a means for detaching the blanket 14 from the housing for washing. The housing is covered with upholstery material 18. Anchor means 36 is a stake, which may be plastic wood or metal, which is inserted through loop 34 affixed to the housing. Various pockets 24, 26, 28, 30 and 32 may be used to carry items such as cigarettes, cards, lotion, a radio, a paperback book, a magazine, or sunglasses. It is contemplated that stereo radio speakers could be built into each end of the housing, but it is also realized that this would greatly increase the cost of the apparatus.

FIG. 3 is a front elevation, partly in cross-section, taken along line 3—3 of FIG. 2. FIG. 3 shows the apparatus 10 having a housing with end caps 13 and 15, upholstered covering 18, carry strap 16 and towel 14 extending outwardly through longitudinal slot 42.

FIG. 4 is a left side, elevational view of the apparatus of the invention in a closed, or rolled up, configuration. Therein, apparatus 10 includes the housing 12 having end cap 15, blanket 14 shown rolled up on wind-up mechanism 38 (in phantom), stop 22 which prevents the blanket 14 from completely entering the housing 12, pocket 24 and anchor loop 34. Slot 40, in phantom, accepts the rectangular extension of wind-up mechanism 38.

FIG. 5 is a rear elevation of the apparatus 10 showing the housing 12 having end caps 13 and 15, carry strap 16, upholstery 18, anchoring stake 36 fitted through loop 34 and the various pockets 24, 26, 28, 30 and 32.

FIG. 6 is rear elevation of end cap 15 showing slot 40 which accepts the rectangular extension of wind-up mechanism 38.

FIG. 7 is an elevational view, partly in cross-section, taken substantially along line 7—7 of FIG. 2. Therein, generally tubular-shaped housing 12, having end caps 13 and 15 and upholstered covering 18, houses the wind-up mechanism 38 whose right rectangular extension extends into slot 40 and whose left cylindrical extension extends into opening 44. The blanket 14 is seen to be taken up on wind-up mechanism 38 and to this extent FIG. 7 differs from FIG. 2.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Portable, lightweight apparatus for beach use comprising, in combination:

(a) a generally tubular housing having a length approximately equal to the width of a standard beach blanket, said housing having a slot opening running along substantially its entire length, said housing containing therein (b) a convolute, spring-actuated roller wind-up mechanism, said wind-up mechanism having affixed thereto (c) one end of a standard beach blanket, said beach blanket extending outwardly through said slot opening and having a stop mechanism affixed to its other end remote from said wind-up mechanism, said housing having affixed thereto (d) mean for anchoring said housing in sand, (e) said beach blanket having zipper means located in proximity to said housing and extending transversely across the entire width of said blanket, said housing having (f) a plurality of pocket means for carrying various items that one might need at a beach, said housing having affixed thereto (g) handle means for carrying said apparatus.

whereby, said apparatus may be easily carried to a beach, placed on the sand at the beach and anchored therein, said blanket may be unrolled from said housing and used for sunbathing, following which the blanket may be rolled back up into said housing, the anchor means removed, and the apparatus carried away.

2. The apparatus of claim 1 wherein the exterior of said housing is upholstered for use as a pillow.

3. The apparatus of claim 2 wherein the exterior of said housing is upholstered with Naugahyde.

4. The apparatus of claim 1 wherein said anchor means is at least one stake extending through a loop affixed to said housing.

5. The apparatus of claim 1 wherein said handle means is a strap having its ends affixed to the ends of said housing.

* * * * *